US007874706B2

(12) United States Patent
Carle, Jr.

(10) Patent No.: US 7,874,706 B2
(45) Date of Patent: Jan. 25, 2011

(54) SHADE FOR A RECESSED LIGHT FIXTURE

(75) Inventor: William A. Carle, Jr., St. Joe, MI (US)

(73) Assignee: Lake Shore Studios, Inc., Saint Joseph, MI (US)

( * ) Notice: Subject to any disclaimer, the term of this patent is extended or adjusted under 35 U.S.C. 154(b) by 272 days.

(21) Appl. No.: 12/137,790

(22) Filed: Jun. 12, 2008

(65) Prior Publication Data

US 2009/0310370 A1 Dec. 17, 2009

(51) Int. Cl.
*F21V 1/08* (2006.01)
*F21V 15/00* (2006.01)
*F21V 11/00* (2006.01)

(52) U.S. Cl. ..... 362/359; 362/147; 362/356; 362/365; 362/366

(58) Field of Classification Search ..... 362/147, 362/364, 365, 366, 356, 357, 359
See application file for complete search history.

(56) References Cited

U.S. PATENT DOCUMENTS

| | | | | |
|---|---|---|---|---|
| 5,465,199 | A * | 11/1995 | Bray et al. | 362/364 |
| 5,738,437 | A | 4/1998 | Ilagan | |
| D417,746 | S | 12/1999 | Pahl | |
| 6,497,501 | B1 | 12/2002 | Harder | |
| 6,832,846 | B2 | 12/2004 | Lagonegro | |
| 7,121,684 | B2 | 10/2006 | Barozzini et al. | |
| 7,198,391 | B2 | 4/2007 | Rutchik | |
| 7,217,007 | B2 | 5/2007 | Choi | |
| 2006/0256566 | A1 * | 11/2006 | Beghelli | 362/365 |

* cited by examiner

*Primary Examiner*—Stephen F Husar
*Assistant Examiner*—James W Cranson
(74) *Attorney, Agent, or Firm*—Barnes & Thornburg LLP

(57) ABSTRACT

A shade for a recessed light fixture and a method of making same. In some embodiments the shade may include an attachment mechanism configured to flush mount the shade to a recessed light fixture.

11 Claims, 4 Drawing Sheets

SHADE FOR A RECESSED LIGHT FIXTURE

TECHNICAL FIELD

This invention generally relates to recessed light fixtures; in particular, the invention relates to a shade for a recessed light fixture.

BACKGROUND

Recessed light fixtures are in wide-spread use. Typically, they are installed in a ceiling and direct light downward to the floor. Although recessed lights provide more indirect lighting than other types of light fixtures, the light source is often still readily visible from many different positions in the room. This glare can be unsightly and may cause discomfort to persons in the room.

SUMMARY

According to one aspect, the invention provides a shade for a recessed light fixture. In some embodiments, the shade may include an elongated shade body having a top end and a bottom end. An attachment mechanism may be coupled with the top end of the shade body. In some cases, the attachment mechanism may be configured to flush mount the shade body to a recessed light fixture. Embodiments are contemplated in which the shade body could be either translucent or transparent, or a combination of both. For example, a portion of the shade body could be made from glass, paper, and/or fabric. Typically, the attachment mechanism is configured to form an interference fit between a flange of the recessed light fixture and a ceiling. For example, the attachment mechanism may include a distal end configured to form an interference fit with the recessed light fixture. In some embodiments, the distal end may be rotatable with respect to the shade body. For example, the distal end could rotate in a substantially horizontal plane.

According to another aspect, the invention provides a method for making a shade for recessed light fixtures. That method may include the step of providing a shade body that defines a passageway and has top and bottom ends. In some cases, the method may include mounting an attachment mechanism to the top end of the shade body. Typically, the attachment mechanism would be configured to flush mount the shade to a recessed light fixture.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
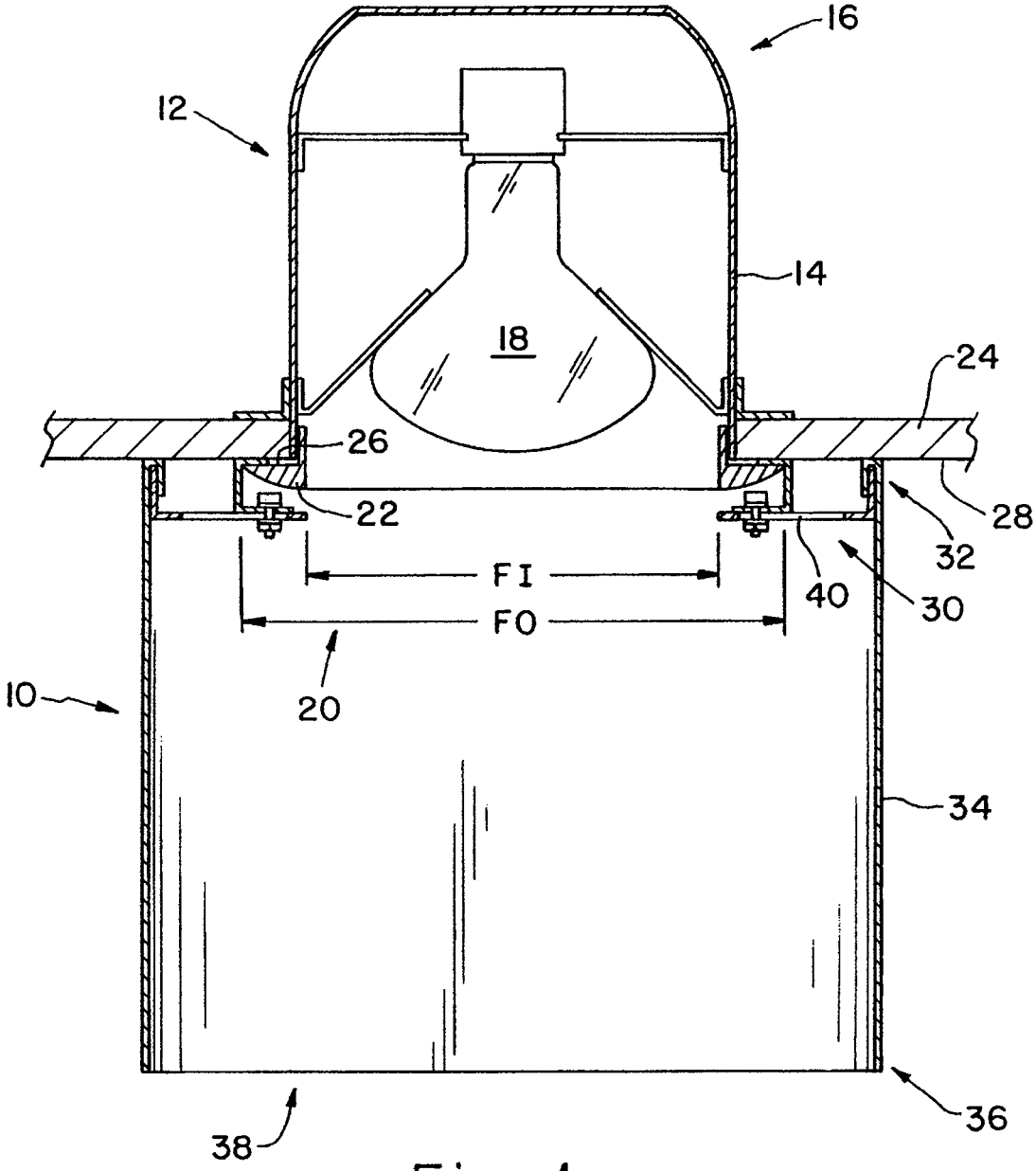
FIG. 1 is a side cross-sectional view of an example shade flush mounted to a recessed light fixture, according to an embodiment of the invention.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

In the illustrative embodiment shown in FIG. 1, a shade 10 is flush mounted to a recessed light fixture 12. The terms "flush mount" and "flush mounted" mean the shade is coupled to a recessed light fixture such that at least a portion of the top end of the shade is immediately adjacent the outer surface of the ceiling in which the recessed light fixture is installed, without any gap (or an insubstantial gap) therebetween. The recessed light fixture 12 is shown for example purposes only, but could be any type, style, or size of recessed light fixture, which are also commonly known as "can lights." The recessed light fixture 12 is a conventional light fixture and does not form any part of the invention. The terms "couple" and "coupled" are broadly intended to encompass both direct and indirect coupling.

In this example, the recessed light fixture 12 includes a can portion 14 with a base 16 that typically houses a light source 18. The can portion 14 includes an open end 20 through which light radiates. An annular flange 22 extends from the open end 20 of the can portion 14. The flange 22 has an inner diameter ("FI") and an outer ("FO"). As shown, the can portion 14 extends into a hole in a ceiling 24 to project light downward. Without the shade 10 installed, an upper surface 26 of the flange 22 would be immediately adjacent to an outer surface 28 of the ceiling 24. In this example, however, an attachment mechanism 30 couples the shade 10 to the recessed light fixture 12 so the shade 10 is suspended above the floor. In this example, with a flush mounted arrangement, the top end 32 of the shade 10 is immediately adjacent the outer surface 28 of the ceiling 24 without a gap (or an insubstantial gap) therebetween.

Figure 2:
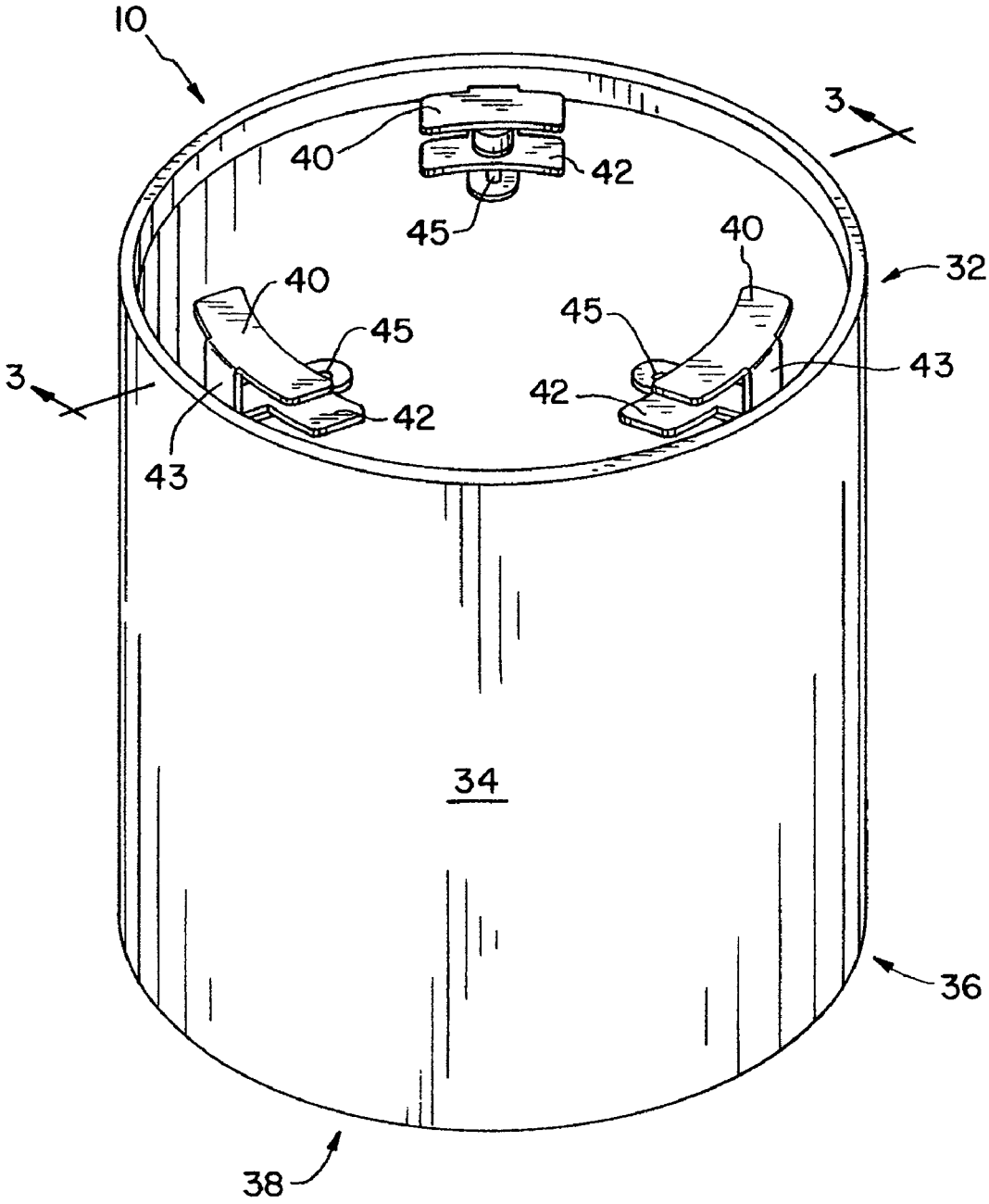
FIG. 2 is a perspective view of the example shade shown in FIG. 1.
Figure 4:
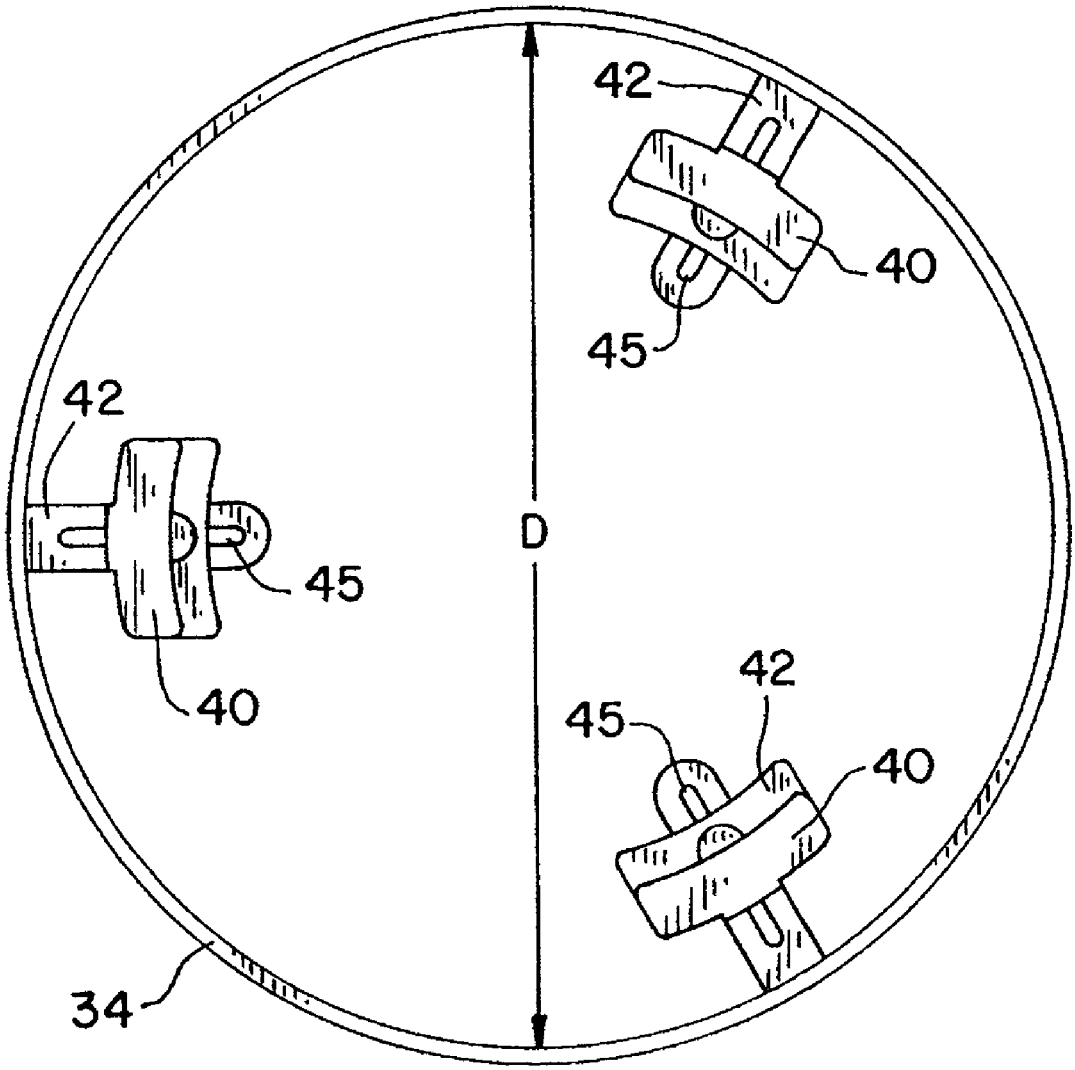
FIG. 4 is a top view of the example shade shown in FIG. 1.

FIG. 2 is a perspective view of the example shade 10 shown in FIG. 1. The shade 10 has a shade body 34 with a top end 32 and a bottom end 36. In some cases, such as the embodiment shown, the shade 10 may include a passageway 38 for light to pass therethrough. Embodiments are contemplated in which the shade 10 may not include a passageway 38, such as embodiments in which a portion of the shade is transparent or translucent. Although the shade body 34 has a cylindrical shape in this example, it should be appreciated that the shade body 34 could have an infinite number of shapes, sizes, and styles. The shade body 34 could be formed from a variety of materials for desired optical effects, including materials that are transparent, translucent, opaque, or a combination thereof. The materials for the shade body 34 could include, but are not limited to, fabric, leather, glass, plastic, paper, metal, and/or wood. As shown, the shade body 34 has an inner diameter ("D"), as best seen in FIG. 4. Typically the inner diameter D is greater than the outer diameter FO of the flange 22.

In the example shown, the top end 32 of the shade 10 includes an attachment mechanism 30. In the embodiment shown, the attachment mechanism 30 includes arms 40 that are configured to create an interference fit between the flange 22 and the ceiling 24. As shown, the arms 40 are suspended above arm mounting portions 42 via a linking member 43. In some cases, the arms 40 could be movable along the arm mounting portions 42 to adjust to various sized of recessed light fixtures. For example, in the embodiment shown, the arm mounting portions 42 include slots 45 along which the arms 40 are movable. Embodiments are contemplated in which the arms 40 could be adjusted by pivoting about arm mounting portions 42. The arm mounting portions 42 could include a base 47 (see FIG. 3) coupled with the shade body 34. In some embodiments, the arm mounting portions 42 could be unitary with the shade body 34.

Figure 3:
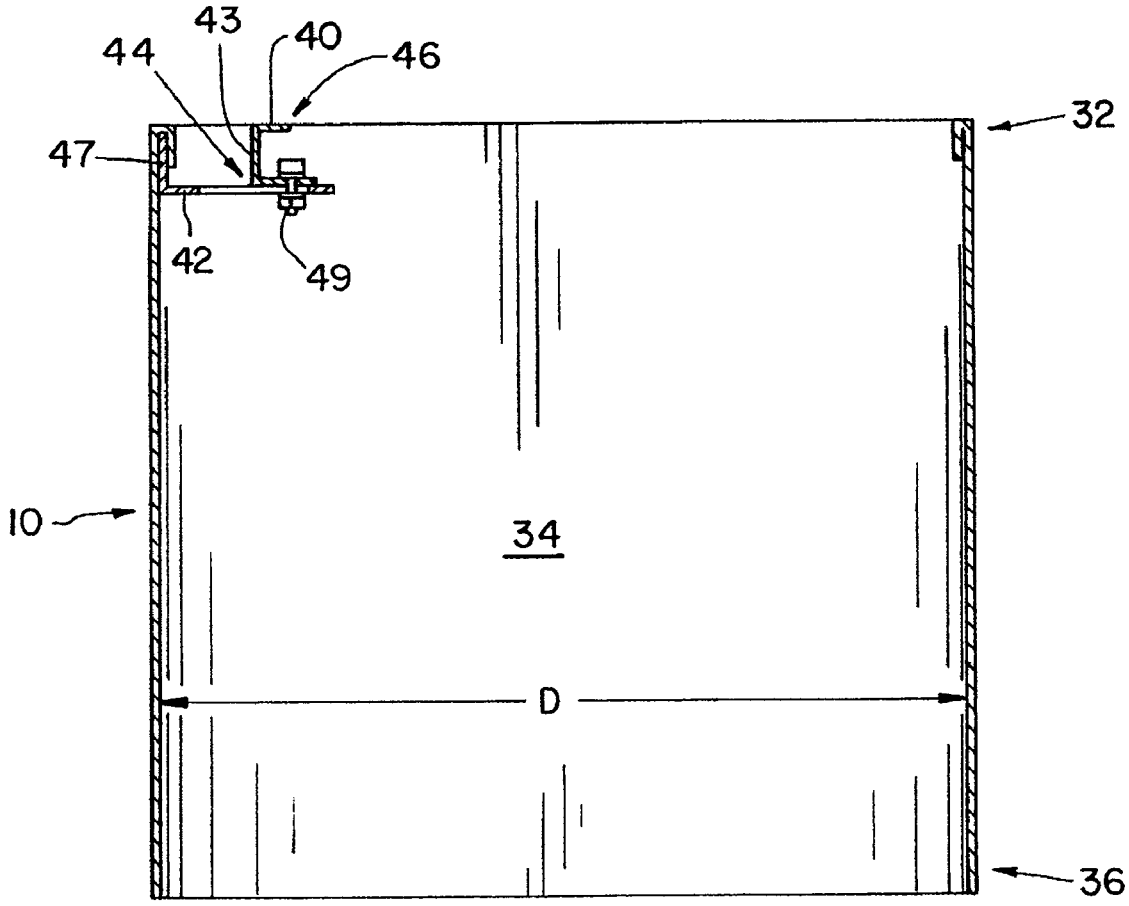
FIG. 3 is a side cross-sectional view of the example shade shown in FIG. 1 along line 3-3.

FIG. 3 is a side cross-sectional view of the example shade 10 shown in FIG. 1. In this example, a proximal end 44 of the arm 40 is coupled with the arm mounting portion 42 with fasteners 49, while the distal end 46 of the arm 40 extends into the passageway 38 of the shade body 34. As shown, the distal end 46 extends from the arm mounting portion 42. This allows the distal end 46 to engage the flange 22 of the light fixture 12.

FIG. 4 is a top view of the example shade 10 shown in FIG. 1. In this example, each of the arms 40 is capable of moving along the slots 45 in the arm mounting portions 42. As shown, the arms 40 are movable in a substantially horizontal plane. This allows adjustment of the distal end 46 of the arms 40 to be coupled with the recessed light fixture 12. The arms 40 may be interposed between the upper surface 26 of the flange 22 and the outer surface 28 of the ceiling 24. In the example shown, this would be caused movement of one or more of the arms 40 to position the distal end 46 between the outer diameter FO and the inner diameter FI of the flange 22. It should be appreciated that other mechanisms for creating an interference fit between the top end 32 of the shade 10 and the recessed light fixture 12 could be provided. For example, the attachment mechanism 30 could have a portion that rotates between an extracted position that engages the flange and a retracted position to release the shade 10. In the embodiment shown, the arms 40 are circumferentially-arranged approximately 120 degrees apart; however, it should be appreciated that other arrangements of the attachment mechanism 30 could be provided. For example, embodiments are contemplated in which less than three arms 40 could be provided; likewise, more than three arms could be provided in the attachment mechanism 30.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A shade for a recessed light fixture comprising:

an elongated shade body having a top end and a bottom end, an attachment mechanism proximate the top end of the shade body, wherein the attachment mechanism is configured to flush mount the shade body to a recessed light fixture;

wherein the attachment mechanism includes a proximal end coupled with the top end of the shade body and a distal end configured to form an interference fit between the flange of the recessed light fixture and the ceiling; and wherein the distal end is movable with respect to the shade body in a substantially horizontal plane.

2. The shade as recited in claim 1, wherein at least a portion of the shade body is at least one of translucent and transparent.

3. The shade as recited in claim 2, wherein at least a portion of the shade body is at least one of glass, paper, and fabric.

4. The shade as recited in claim 1, wherein the shade body is approximately cylindrical in shape and wherein an inner diameter of the shade body is greater than an outer diameter of the flange of the recessed light fixture.

5. A shade for a recessed light fixture comprising:

a cylindrical shade body defining a passageway therethrough, wherein the shade body has a top end and a bottom end; and an attachment mechanism having one or more movable arms configured to couple the shade body to the recessed light fixture, wherein the arms are movable to a position that engages a flange of a recessed light fixture.

6. The shade as recited in claim 5, wherein a distal end of the arms is planar in shape.

7. The shade as recited in claim 6, wherein a proximal end of the arms is planar in shape.

8. The shade as recited in claim 7, wherein the distal end is vertically offset from the proximal end.

9. The shade as recited in claim 5, wherein the attachment mechanism includes three arms circumferentially arranged on the top end of the shade body approximately 120 degrees apart from each other.

10. The shade as recited in claim 5, wherein the attachment mechanism is disposed within the passageway defined in the shade body.

11. The shade as recited in claim 5, wherein the arms are linearly movable with respect to the shade body.

* * * * *